United States Patent [19]

Fisher

[11] 4,156,892

[45] May 29, 1979

[54] ELECTRICALLY ADAPTED ARTIFICIAL TREE LIMB

[76] Inventor: Royal P. Fisher, 6119 Highland Dr., Mountain Green, Utah 84050

[21] Appl. No.: 834,128

[22] Filed: Sep. 19, 1977

[51] Int. Cl.[2] ..... A47G 33/06

[52] U.S. Cl. ..... 362/123; 428/20

[58] Field of Search ..... 428/18–20, 428/7–9, 12; 211/196, 205, 197; 362/122, 123; D11/118

[56] References Cited

U.S. PATENT DOCUMENTS

| | | | |
|---|---|---|---|
| 2,491,237 | 12/1949 | Way | 313/318 UX |
| 2,857,506 | 10/1958 | Minteer | 428/19 X |
| 2,904,716 | 9/1959 | Malm et al. | 313/318 |
| 3,206,593 | 9/1965 | Winnicki, Sr. | 428/18 X |
| 3,214,579 | 10/1965 | Pacini | 428/19 X |
| 3,603,780 | 9/1971 | Lu | 428/20 X |
| 3,617,732 | 11/1971 | Fisher | 428/19 X |
| 3,735,117 | 5/1973 | Hunt | 428/18 X |
| 4,020,201 | 4/1977 | Miller | 428/20 X |

*Primary Examiner*—Henry F. Epstein

*Attorney, Agent, or Firm*—Criddle, Thorpe & Western

[57] ABSTRACT

An artificial tree limb having openings for direct emplacement of light bulbs or other electrical devices within the trunk section of the limb to obtain electrical contact. Two conductive wires are contained within the trunk structure, a portion of each being exposed at each opening to enable direct physical and electrical contact therewith by electrical contacts of the light bulb or electrical device.

12 Claims, 6 Drawing Figures

ELECTRICALLY ADAPTED ARTIFICIAL TREE LIMB

BACKGROUND OF THE INVENTION

This invention relates to decorative artificial structures which are adapted for use with electrical devices.

With the increased interest in artificial flowers, plants and trees, partly because of the safety and long-life aspects of such items, new methods of decorating such artificial foliage is receiving increased attention. One of the areas of greatest interest arises with respect to Christmas trees and methods of decorating them with various ornaments, including electric lighting. An exemplary prior art arrangement is disclosed in U.S. Pat. No. 3,617,732.

With most prior art artificial trees where lighting or other electrical devices are required along the length of the limb structure, conventional strings of separate lights are required. These are typically wound around or clipped to the limb structure. In view of the fact that the use of such additional circuits of lighting tends to defeat the ease in assembly and disassembly, which is an important aspect in the popularity of artificial trees, it would be desirable to have such an artificial tree which preserves simplified assembly procedures while at the same time providing the amount of decoration traditionally associated with Christmas trees and similar items of decoration.

OBJECTS AND SUMMARY OF THE INVENTION

It is an object of the present invention to provide artificial limb structure adapted to receive electrical devices for decorating intermediate sections of the limb.

It is a further object of the present invention to provide limb structure adapted for electrical devices which can be inserted or removed with ease directly to or from the trunk section of the limb structure.

It is yet a further object of the present invention to provide limb structure specifically adapted to be part of an artificial Christmas tree configuration and similar configurations.

These and other objects are realized in an artificial tree limb comprising an elongate trunk section constructed of electrical insulative material. A pair of conductors is contained within the trunk section, extending along its length, and is exposed at one or more locations along the trunk section. With this structure, electrical devices may be easily inserted along the length of the trunk section of the limb without the additional expense of utilizing socket structure typically required to receive the electrical contacts of a device. That is, devices having exposed electrical contacts may be inserted into openings in the trunk section where the conductor pair is exposed so that the contacts of the device and the exposed conductors make physical and electrical contact. This structure therefore provides the desired ease of assembly and disassembly, since the electrical devices or light fixtures can be retained in the separated limb structures during storage. Likewise, the additional intermediate electric connections along the limb structure provide increased depth of lighting throughout the assembled tree configuration, as is consistent with traditional Christmas tree lighting. Other objects and features will become apparent to persons skilled in the art from the following detailed description, presented in connection with the accompanying drawings.

DETAILED DESCRIPTION OF THE INVENTION

Figure 1:
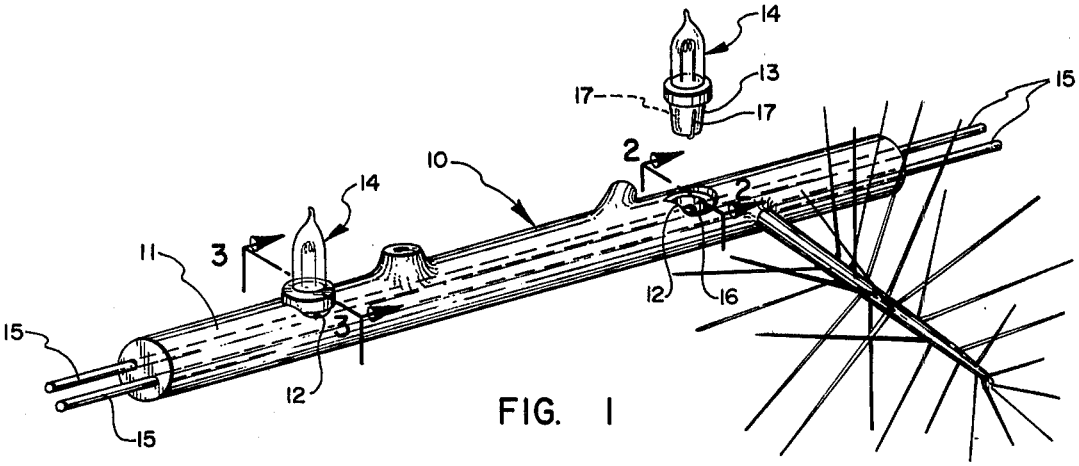
FIG. 1 shows a fragmentary perspective view of an artificial limb configured in accordance with the present invention.

An artificial tree limb 10 illustrative of the present invention is shown in FIG. 1. The limb structure includes an elongate trunk 11 fabricated to resemble a branch segment of a Christmas tree or other type of plant. The trunk 11 may be constructed of numerous types of insulating plastics or other materials which are suitable in physical and chemical characteristics for the types of uses anticipated, and are likewise economically feasible to produce. Most materials presently being utilized for fabrication of artificial plants and trees can be utilized in the present invention.

One or more opening means 12 are located along the length of the limb structure and serve as receptacles for the base portion 13 of an electrical device 14. These opening means are preferably fabricated to match the dimensions and configuration of the base portion 13 to be inserted therein. The openings 12 shown in FIG. 1 have been configured to receive a tapered rectangular base typically associated with small Christmas lights.

Figure 4:
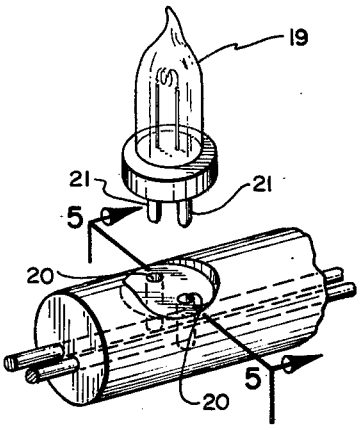
FIG. 4 is a perspective view of a second embodiment of an artificial limb representing the present invention.
Figure 3:
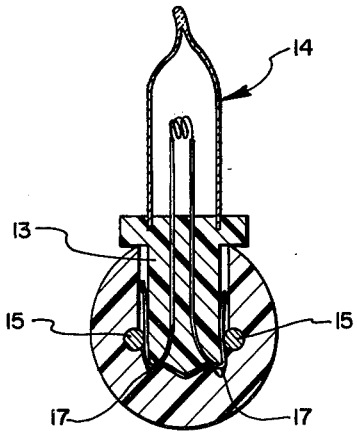
FIG. 3 is a cross-sectional view taken along lines 3—3 of FIG. 1 and showing an inserted light fixture.

In view of the many geometrical shapes available for base structures, it is apparent that many opening configurations are envisioned by the subject invention. FIG. 4, for example, illustrates a second opening means for use with a two-pronged base portion of a Christmas light. A pair of conductors 15 extend within the trunk structure and are located at the respective openings 12 such that a portion of each respective conductor 16 is exposed within each respective opening 12. As an electrical device 14 is inserted into the opening means 12, electrical contacts of the device 17 are impressed against the respective conductors 15. This concept is more clearly demonstrated in FIG. 3, where the electrical contacts 17 are clearly shown in direct physical and electrical contact with two conductive wires 15, whose separated distance is approximately equal to the width of the illustrated light fixture base 13. This configuration provides the desired tight fit of the base within the opening which operates to impress the electrical contacts 17 against the conductive wires 15.

As has been previously stated, a primary element of the present invention requires that the conductors which extend along the trunk section 11 have exposed surfaces at each opening means 12. It is apparent that these exposed conductor surfaces must be positioned at appropriate points of expected physical contact with the electrical contacts of the light fixture. The referenced drawings show three different locations of the conductive wires which illustrate some of the variations which may be used, depending on the type of electrical device to be inserted.

Figure 2:
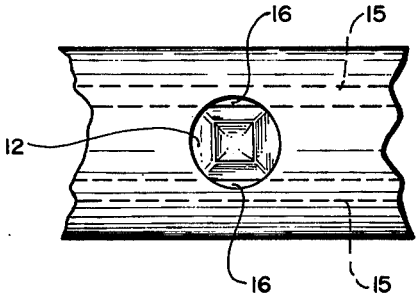
FIG. 2 is a top plan view taken along lines 2—2 of FIG. 1.

As shown in FIG. 2, the conductors have been located laterally of the opening 12, providing exposed facing surfaces 16 for contact with an electrical device having laterally disposed contact points 17. These exposed surfaces 16 may either extend partially into the opening area 12 or may be recessed within a communicating channel opening into the opening for obtaining the desired electrical contact with the recessed conductor surface.

In the first case, the extending, exposed conductor surfaces operate to apply most of the lateral force experienced by the light fixture base through the conductors at the exposed surfaces thereof. With respect to the latter configuration of recessed exposed surfaces, lateral spring elements can be used in combination with the electrical device base which cause a conductive electrical contact to slide into direct physical and electrical contact with the exposed surface wires within the respective communicating channels to these exposed surfaces. It will be apparent to those skilled in the art that other means of obtaining the direct physical and electrical contact can be implemented with this opposing lateral orientation of exposed conductor wires.

Figure 5:
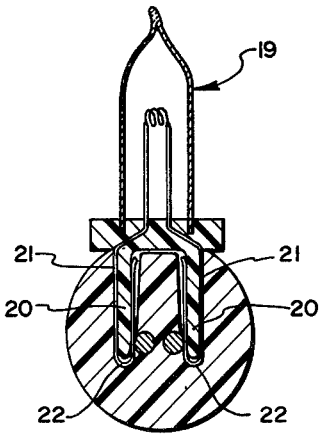
FIG. 5 shows a cross-sectional view of this second embodiment, taken along the lines 5—5 of FIG. 4.

In addition to these laterally disposed, exposed, facing surfaces, FIGS. 4 and 5 illustrate the use of outer laterally exposed, opposing conductor surfaces for use with a typical two-prong light fixture 19. In this configuration, the two prongs 21 of the light fixture 19 are inserted into the opening means 20. Electrical contacts such as wire leads 22 are disposed along the inner facing surfaces of the respective prongs 21 such that physical contact with the exposed opposing conductor surfaces results upon insertion of the device into the opening means 20.

In view of the tension impressed upon the respective conductors by the base section of the electrical device, the conductors should be capable of resisting displacement away from the physical contacting location. One method of ensuring proper positioning of the respective conductors is to imbed them within the limb structure at the appropriate position so that they remain fixed and substantially immovable, at least at the respective points of physical contact with the electrical device.

Numerous procedures are currently available within the plastics industry for implementing this enclosing structure around the respective conductors. The exposed conductor surfaces can be preserved during the fabrication procedures or can be developed by removing an enclosing portion of the plastic material from the conductor surface within the opening means provided.

Figure 6:
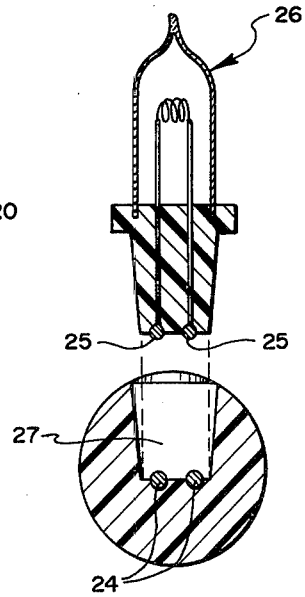
FIG. 6 depicts an additional embodiment of an aritifical tree limb mode in accordance with the present invention.

FIG. 6 discloses an additional configuration involving the inventive concept of direct physical and electrical contact between enclosed conductive wires 24 and the electrical contacts 25 of the light fixture 26. In this configuration, the conductors 24 are exposed in the same side facing into the opening means 27. The light fixture 26 is inserted into the opening until physical contact occurs between the conductors 24 and the electrical contacts 25 of the device.

The concept of inserting electrical devices directly into the artificial limb structure to obtain physical and electrical contact with a pair of exposed conductors provides several benefits over prior art structure. Economically, the cost of sockets and associated hardware is eliminated, since the limb structure operates as housing structure for the base of the inserted device. Also eliminated is the need for intermediate leads for electrically connecting the device contacts to a current source, the insertion of the device into an opening means automatically resulting in electrical coupling to the current source.

Fabrication costs are reduced in view of the absence of need for soldering contacts to a socket device and similar circuitry assembly requirements. Maintenance problems associated with broken leads to such sockets are likewise eliminated.

Perhaps most important, however, is the increased convenience for use as an artificial Christmas tree limb. With a base section of the limb adapted for quick disconnect to a main trunk structure, a Christmas tree comprised of such limbs could be assembled and disassembled without the need of removing lights or other electrical devices displayed thereon. Furthermore, the distracting appearance of electric cords and sockets is eliminated, leaving only the more aesthetically pleasing limb structure.

Although preferred forms of the present invention have been described herein, it is to be understood that this disclosure is by way of example and that numerous variations are possible without departing from the scope of the hereinafter claimed subject matter which is to be regarded as the invention.

I claim:

1. An artificial tree limb, comprising:

a. an elongate trunk section constructed of electrical insulative material;

b. a pair of conductors extending along and within the trunk section in spaced apart relationship; and c. opening means within said trunk section for removably receiving therein a base portion of an electrical device with associated electrical contacts attached at said device, said opening means providing a receptacle for said base portion formed within the insulative material of said limb structure, said opening means further having nonterminal surfaces of the conductors exposed within said receptacle to enable direct physical and electrical contact between said contacts of the electrical device and the respective exposed conductors.

2. An artificial limb as defined in claim 1, wherein the exposed surfaces of said conductors are at opposing facing surface of said conductors and extend sufficiently toward said opening means to cause physical abutment between said surfaces and an inserted pair of electrical contacts of said electric device.

3. An artificial limb as defined in claim 1, wherein the exposed surfaces of said conductors are at laterally opposing conductor surfaces which extend sufficiently toward separate openings to cause physical abutment of said surfaces against electric contacts inserted therein.

4. An artificial limb as defined in claim 1, wherein the exposed surfaces of said conductors are at the same side of said conductors facing into said opening means and are located at the base of said opening means to enable physical contact between said surfaces an electrical contact inserted therein.

5. An artificial limb as defined in claim 1, wherein said opening means is adapted for receiving a light bulb having exposed electrical contacts for obtaining direct physical and electrical contact with said conductors when fully inserted therein.

6. An artificial limb as defined in claim 1, wherein the conductors are imbedded within said insulative material in fixed spacial position, said conductors being enclosed therein except for the exposed surfaces at said openings for receiving electrical and physical contact with the respective contacts of the device.

7. An artificial limb as defined in claim 1, further comprising means for physically and electrically coupling said limb to a supporting trunk structure, said trunk structure having means for receiving a plurality of such limbs.

8. An artificial limb as defined in claim 7, wherein the trunk structure and limbs are adapted to represent a Christmas tree.

9. An artificial tree limb, comprising:

a. An elongate trunk section constructed of insulative material and fabricated to simulate plant structure, said trunk section having opening means therein for removably receiving and retaining a base portion of an electrical device; and b. A pair of conductors extending within and along a portion of said trunk section in spaced apart relationship, each of said conductors at least partially intercepting said opening means and having an exposed surface therein for permitting physical and electrical contact with an electrical contact of said electrical device.

10. An artificial tree limb, comprising a. an elongate trunk section constructed of electrical insulative material;

b. a pair of conductors extending along and within the trunk section in spaced apart relationship; and c. opening means within said trunk section which exposes a nonterminal surface of each of said conductors to the interior of said opening means, said opening means constituting a receptacle which permits direct insertion and removal of an electrical device to and from physical contact with the exposed surfaces of said pair of conductors, said physical contact being adapted to provide direct electrical coupling to said device through said trunk section.

11. An artificial tree limb as defined in claim 10, wherein said electrical device is a lamp.

12. An artificial tree limb as defined in claim 10, further comprising a lamp having direct physical contact with the exposed surfaces of said conductors.

* * * * *

UNITED STATES PATENT AND TRADEMARK OFFICE

CERTIFICATE OF CORRECTION

PATENT NO. : 4,156,892

DATED : May 29, 1979

INVENTOR(S) : Royal P. Fisher

It is certified that error appears in the above-identified patent and that said Letters Patent are hereby corrected as shown below:

In Claim 4, column 4, line 60, delete "an" and replace therefor --and--.

In Claim 6, column 5, line 1, delete "spacial" and replace therefor --spatial--.

Signed and Sealed this

Ninth Day of October 1979

[SEAL]

*Attest:*

RUTH C. MASON
*Attesting Officer*

LUTRELLE F. PARKER
*Acting Commissioner of Patents and Trademarks*